US006853304B2

(12) United States Patent
Reisman et al.

(10) Patent No.: US 6,853,304 B2
(45) Date of Patent: Feb. 8, 2005

(54) MONITORING DEVICE

(75) Inventors: Yoav Reisman, Raanana (IL); Natan Galperin, Zoran (IL); Gil Gemer, Nirit (IL); Guy Lerner, Zur lgeal (IL); Anka Levin, Kfar-Saba (IL)

(73) Assignee: Dmatek Ltd., Tel Aviv (IL)

( * ) Notice: Subject to any disclaimer, the term of this patent is extended or adjusted under 35 U.S.C. 154(b) by 233 days.

(21) Appl. No.: 10/139,634

(22) Filed: May 7, 2002

(65) Prior Publication Data

US 2003/0210149 A1 Nov. 13, 2003

(51) Int. Cl.[7] ..... G08B 23/00

(52) U.S. Cl. ..... 340/573.4; 340/568.2; 340/539.31

(58) Field of Search ..... 340/573.4, 568.2, 340/539.31, 533, 687, 573.1, 531, 573.7, 689

(56) References Cited

U.S. PATENT DOCUMENTS 5,621,384 A * 4/1997 Crimmins et al. ..... 340/539.3
5,828,306 A * 10/1998 Curran ..... 340/573.4
5,831,535 A * 11/1998 Reisman et al. ..... 340/573.4
5,841,352 A * 11/1998 Prakash ..... 340/573.4
5,883,576 A * 3/1999 De La Huerga ..... 340/573.1
6,166,639 A * 12/2000 Pierce et al. ..... 340/573.1

* cited by examiner

*Primary Examiner*—Anh V. La
(74) *Attorney, Agent, or Firm*—Crowell & Moring LLP

(57) ABSTRACT

A monitoring device, such as a watch, for monitoring, at a remote location, movements and activities of a person, the device is worn around the wrist of the person being monitored, the device comprising, a housing, a strap connected to the housing for fastening the device around the wrist of the person being monitored, a tamper sensor for detecting tampering with or the removal of the device from the person's wrist. It further includes electronic circuitry enclosed within the housing. The circuitry includes a microprocessor and a memory device for receiving and processing data and a transmitter for periodically transmitting data to a remote location and a time display, coupled to a clock mechanism, mounted in the housing so as to be displayed at the front face of the housing.

23 Claims, 6 Drawing Sheets

MONITORING DEVICE

BACKGROUND OF THE INVENTION

1. Field of the Invention

The present invention generally relates to electronic monitoring systems and in particular to a monitoring device especially suitable for monitoring persons suffering from handicap dementia, down syndrome, autism, and other developmental problems.

2. Discussion of the Related Art

Electronic monitoring systems for monitoring and supervising moving objects, and in particular for monitoring persons, are known in the art. Such systems are employed for a wide range of applications in a variety of fields, including security, law enforcement, medical and more. An electronic monitoring system typically comprises one or more portable transmitting devices, known as "tags", attached to a monitored object, one or more local monitoring units for receiving signals from said tags, and optionally a central monitoring station where information from local monitoring units is collected and optionally further processed. A transmitting tag typically broadcasts identification information and may further include additional information regarding activities or state of the monitored object. When used for monitoring persons, the portable tag is usually strapped around a limb of the person being monitored and typically includes various sensors for sensing tampering with the tag and other activities of the monitored person. However, when a monitoring system is used for monitoring patients and especially patients who suffer from dementia related diseases, such as Alzheimer, special considerations should be taken into account.

Dementia is a chronic or persistent disorder of behavior and higher intellectual function due to organic brain disease. It is marked by memory disorders, changes in personality, deterioration in personal care, impaired reasoning and disorientation. Although more abundant with aged people, various dementia related disorders also occur in young or middle age people. The most common cause of dementia is Alzheimer's disease. Other causes of dementia include successive strokes (vascular dementia), severe or repeated head injury, cardiac arrest, toxic ingestion and chronic infections of the central nervous system. Alzheimer disease is a progressive form of dementia, characterized by loss of short-term memory, deterioration in behavior and intellectual performance, confusion and slowness of thought. Dementia usually begins slowly and worsens over time at a progressive rate, which varies with different people. Although most dementias are incurable, supportive environment is very important for patients' optimal functioning. Patients with early to intermediate dementia usually function best in familiar surroundings, i.e., at home, but as a patient's condition deteriorates, a nursing home may provide the best care.

One of the main problems associated with Alzheimer disease and other dementia disorders is disorientation in both time and space, which too often results in patients wandering away and losing their way back. Such incidents might put the patients in life-threatening situations. Consequently, dementia patients need to be under continuous monitoring supervision for their own safety. However, at all stages, and especially during early and intermediate stages, the balance between patients safety and independence is very important.

Due to their mental condition, dementia patients do not cooperate easily with their caretakers. Moreover, dementia disorders are often accompanied with paranoia-like symptoms, making it even more difficult to supervise the patients. Dementia patients tend to get agitated easily and a too noticeable supervision might worsen their condition, especially at earlier stages of the disease. Similar symptoms can be seen in patients with autism, mental retardation and other patients in need of personal care or who become disoriented or incapacitated and the like. In addition, such symptoms can be seen in patients suffering from psychiatric disorders, such as schizophrenia and the like. For these reasons, an electronic wireless monitoring system may be a good solution for monitoring patients in need of personal care or who become disoriented or incapacitated (such as incapacitation of the higher cerebral function) or of need of nursing. However, current monitoring systems, and in particular, current tags, suffer from a number of drawbacks in this respect. Due to memory deterioration and disability of patients to learn new material, it is almost impossible for patients to get used to new devices. Thus, current tags appear to patients as unfamiliar and intimidating objects, which might arouse their rejection, causing the patients to tamper with the tag either by trying to take them off or to destroy them. Furthermore, current tags draw attention from the surrounding and might draw curious questions which might put patients in embarrassing and intimidating position.

Thus, a monitoring system for monitoring and supervising dementia patients should take into consideration the special behavior and sensitivities of this population. In particular, there is a need for a better monitoring transmitting tag, which would not draw special attention, neither by the patient himself, nor by others. Preferably, the tag should assume the form of a very familiar object, which would not require from the patient any new learning or adaptation.

The present invention by providing a monitoring transmitting device, which has the appearance, dimensions and functioning of a regular wristwatch, reduces patient potential interference with the monitoring system and provides dementia patients and their caregivers safety, dignity and independence.

SUMMARY OF THE PRESENT INVENTION

The present invention overcomes the disadvantages of the prior art by providing an electronic monitoring device having, in addition to a transmitting and monitoring capabilities, the appearance, dimensions and functionality of a common wristwatch. The device is used for monitoring, at a remote location, movements and optionally activities of a person, and is worn around a wrist of the person being monitored. The device is particularly suitable for monitoring patients suffering from dementia and other like or related disorders. The device is also suitable for patients showing symptoms of autism, mental retardation and other patients in need of personal care or who become disoriented or incapacitated. In addition, the device is suitable for patients with patients suffering from psychiatric disorders, such as schizophrenia. The device can be used for monitoring such patients at home or at care centers.

The electronic monitoring device of the invention comprises: a housing having a front face and a back face; at least one strap connected to the housing for securing the device around the wrist of the person being monitored; tamper sensors for detecting cutting and removal of the device from the person's wrist and detecting any damage to the device while still attached to the wrist; an electronic circuitry enclosed within the housing, the circuitry includes a microprocessor and a memory device for receiving and processing data and a transmitter for periodically transmitting data to a remote location; and a time display, coupled to a clock mechanism, mounted in the housing so as to be displayed at the front face of the housing. The time display can be either analogue or digital.

Preferably, securing the device around the wrist of the person being monitored closes an electrical conductivity circuit, wherein the tamper sensor, for detecting the removal of the device from the person's wrist, is an open-closure sensor detecting absence of electrical continuity. Yet, additionally or alternatively, the tamper sensor may comprise of sensors which detect removal of the device by sensing body or sensors which detect any damage to the device while still attached to the wrist, and the like. The tamper sensor may provide indication that a body is near or that damage is being inflicted to the device.

The device includes an identification code stored in the memory device and carried by the signals periodically transmitted by the transmitter. The transmitter can be any transmitter suitable for wireless communication. Preferably, the transmitter is a radio frequency transmitter and the like. The device may further comprise sensors for sensing activities and/or health state of the monitored person, including a movement sensor, a body temperature sensor, a pulse sensor, a blood pressure sensor and a blood oxygen sensor. The data collected by the at least one sensor can be carried by the transmitted signals. The device may further comprise a receiver for receiving data from a remote location, a local monitoring unit or another watch. For example: receiving data via an Infra Red device, receiving audio data, receiving data via a radio frequency device and the like.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

The present invention provides a monitoring transmitting device to be worn around the wrist of a monitored person, especially suitable for patients who suffer from dementia related disorders, such as Alzheimer. The device is also suitable for patients showing symptoms of autism, mental retardation and other patients in need of personal care or who become disoriented or incapacitated. In addition, the device is suitable for patients with patients suffering from psychiatric disorders, such as schizophrenia. In accordance with the present invention, the device comprises a monitoring module including a transmitter for transmitting signals and a time display coupled to a clock mechanism for displaying the time of day, and optionally the date. The device is as simple to wear as wearing a wristwatch. It is lightweight, waterproof, and is provided with tamper alerts, low battery indication and optionally with various sensors for sensing activities and medical parameters of the person being monitored. The device should be: 1) rugged, so that temporary or accidental application or use of force does not damage it; 2) properly secured to the person, so it doesn't "fall off" or easily removed (but can be removed using reasonable force if and when required); 3) "tamper monitored" so that if and when it is damaged or is taken off, notification or indication is provided, and 4) familiar, comfortable and unobtrusive to the wearer. Reference is made throughout this invention to dementia patients include reference to other patients showing symptoms of autism, mental retardation and other patients in need of personal care or who become disoriented or incapacitated, or to patients suffering from psychiatric disorders.

Figure 1:
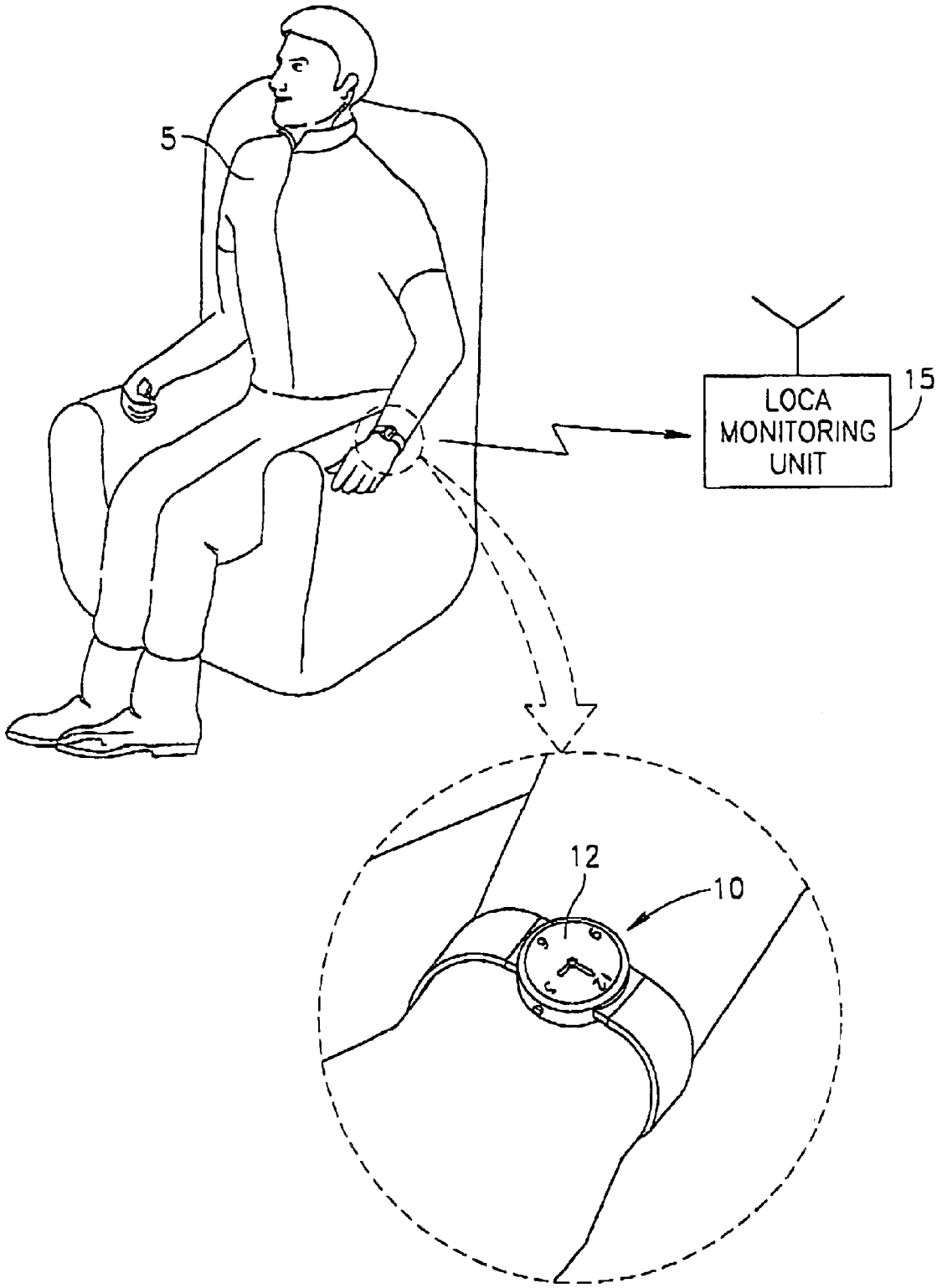
FIG. 1 illustrates a person wearing the monitoring transmitting watch of the present invention.

FIG. 1 illustrates a monitoring device 10 in accordance with the present invention, strapped around the wrist of a person 5, in particular a patient, for monitoring movement and other activities of the person. The data detected by monitoring device 10 is transmitted wirelessly to a local receiving monitoring unit 15 in the general area of the person being monitored. The unit 15 may also be configured to transmit messages to device 10. In accordance with the present invention, monitoring device 10 has the appearance of a regular wristwatch having a time display 12 on the front face. Device 10 not only appears as a regular watch, but also functions as such, displaying the time of day, and optionally the date, of day. Device 10 facilitates best performance of a monitoring system. Being a very familiar object, device 10 does not evoke any negative emotions, which might cause the patient to attempt to remove or to tamper with the device. Also, device 10 does not draw any special attention from other people, which might embarrass or intimidate the patient. Therefore, the device allows the patient to live regular life as much as possible, keeping his self esteem and dignity, while at the same time allowing caregivers continuous monitoring of the patient. Furthermore, it is known that clocks and calendars in their immediate surrounding help to orient dementia patients by keeping a continuous track of time. Thus, having the monitoring device functioning as a clock imparts the device further beneficial effect in this respect as well. In accordance with the invention, the time display may be either analog or digital. The device may further have a vibrator, buzzer or a speaker device for alerting the patient. At a crises situation where the patient is unable to react or to communicate with the surroundings, the device can receive audio signals from a remote location in order to alert and notify the people present around the patient of the crises event. The device may also initiate preprogrammed audio warnings to the patient during the crisis situation. One crisis situation can be an event whereby the patient has left a predetermined area or has tried to remove the device.

FIGS. 2A to 2D depict of a monitoring device 10 in accordance with one embodiment of the present invention. In accordance with this embodiment, the device is having an analog time display 12. As can be seen, device 10 is having the appearance and dimensions of a common analog wristwatch. Device 10 comprises a housing 20 and a pair of straps 16 and 17, connected to opposite sides of housing 20 for strapping the device around the wrist. Housing 20 comprises a hollow flat cylindrical body closed at one open face, hereinafter referred to as the frontal face, by a transparent window 19 and at the second open face, hereinafter referred to as the back face, by cover plate 21. The body of the housing may take various shapes and sizes depending on the specific design used at any given time. It may have for example cylindrical body or rectangle body. A time display 12 is mounted inside watchcase 20 facing transparent window 19. Also encased within housing 20 are a clock mechanism 35 and a monitoring transmitting module 30, which includes an electronic circuitry responsible for the monitoring functioning of device 10. Parts 19, 20 and 21, when assembled, form a hermetically closed waterproof case. In the example shown here, the central part of housing 20 is of a substantially cylindrical shape for accommodating a circular time display table, but it will be easily realized that watchcase 20 can assume any other shape such as a rectangle, a square, an oval, etc. Housing 20 and cover plate 21 can be fabricated from any suitable metal or plastic material Housing 20 is provided with two extensions 23 extending from opposite sides thereof. Extensions 23 include connecting means for connecting straps 16 and 17 to housing 20.

Figure 2B:
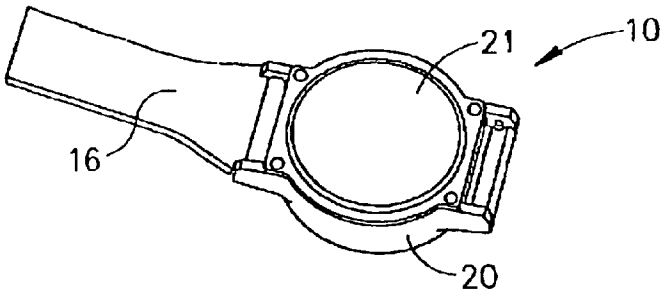
FIG. 2B is a backside perspective view of a monitoring watch of FIG. 2A.
Figure 2D:
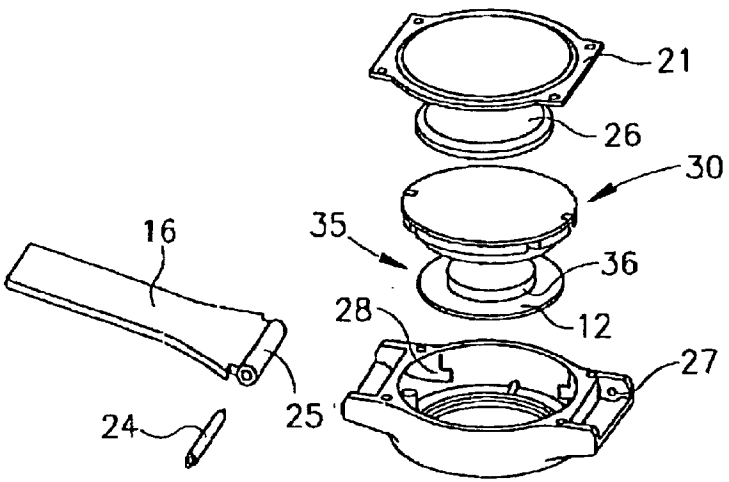
FIGS. 2C and 2D give perspective frontal and backside views, respectively, of a disassembled monitoring watch in accordance with FIGS. A and B.
Figure 2A:
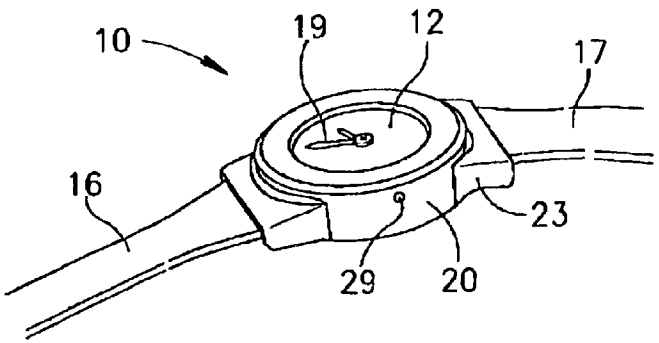
FIG. 2A is a frontal perspective view of a monitoring watch in accordance with one embodiment of the present invention.
Figure 2C:
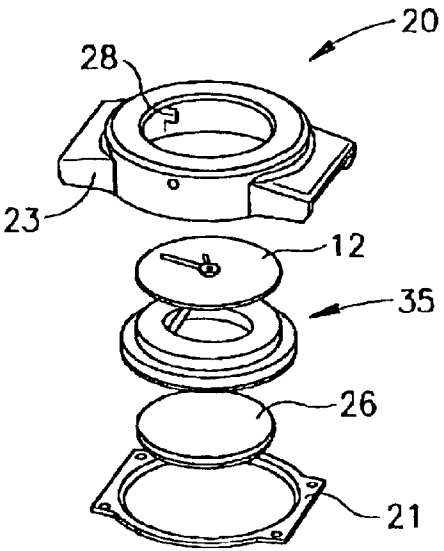

Turning now to FIGS. 2C and 2D, there are shown in more detail the components of device 10 and their assembly. In the embodiment shown here members 23 include a pin 24 which is first inserted into a corresponding loop 25 provided at one end of each of straps 16 and 17. After mounting the strap on pin 24, the two ends of pin 24 are inserted into recesses 27 provided on the opposite walls of extension 23, as is best seen in FIG. 2D. Straps 16 are 17 are provided with means to allow the use of the device with different size persons (not shown). Such means can be, for example, a plurality of holes perforated along the length of one or both straps, through which a closure member can be inserted for fixing the effective length of the straps. Straps 16 are 17 are preferably fabricated from flexible material such as rubber. In accordance with the embodiment shown here, straps 16 and 17 are fabricated from a conductive material, preferably from an electrically conductive rubber or similar material, for example, a rubber doped with carbon particles. In accordance with this embodiment, a metal connector 28 (best seen in FIG. 2D) couples recesses 27 and the inner side of housing 20. Thus, when pin 24, being of a conductive material by itself, is inserted into recesses 27, it is in contact with both the conductive strap and metal contacts 28, enabling a close electrical circuit when the free ends of the straps are engaged. The closure of the circuit is determined by the monitoring transmitting module 30 board (PCB). However, it will be easily realized that other connecting means, which enables electrical continuity between strap and housing 20, can be employed. It will be also realized that straps 16 and 17 can be made of a nonconductive flexible material wherein embedded electrical conductors are extending through the two straps such as to allow a closed electrical circuit when the free ends of the straps are engaged. Various fastening means for engaging the free ends of straps 16 and 17 for securing the device around the wrist can be employed. Where the straps are made of conductive material, any engaging buckle or other known fastening means for engaging the free ends of the straps can be used, providing it ensures a fixed contact between the two straps for maintaining a closed electrical circuit. Where the straps are embedded with electrical conductors, the electric circuit extending through the straps and housing should be constructed such that it is open when the straps are disengaged or cut or tampered with and is closed upon their engagement. Such an arrangement is disclosed for example by U.S. Pat. No. 5,504,474, assigned to the same assignee of the present invention, where a separate closure member is deployed for closing the device both mechanically and electrically. It should be emphasized that although, in accordance with the present invention, the closure means need not be such as to provide a permanent irreversible closure, still it is desirable to design the closure in a way which is not easily being opened. Unlike monitoring devices designed mainly for law enforcement, such as the device disclosed in the above cited U.S. Pat. No. 5,504,474, and in U.S. Pat. Nos. 5,831,535 and 5,936,529, the device of the present invention, aimed at monitoring patients, is not likely to be exposed to sophisticated and malicious tampering attempts. However, dementia and like patients, unaware of the role of the device, might unintentionally take it off. It is therefore desirable to have the device provided with reversible closure means which will allow caregivers to open it for readjustment, or when circumstances require, but which will not be easily opened by the patient himself. Preferably, the arrangement of the closure is such that both hands are required to open the closure. In addition, While the lack or change in electrical conductivity is the preferred method for identifying and detecting a tamper, in accordance with another preferred embodiment of the present invention, the strap may contain optical fibers which continuously transmit signals, detecting a tamper when the sent signals do not reach the receiving end of the strap. An example of such closure means is described below in conjunction with FIG. 3. It should be emphasized that regardless of the closure means, an opening of the strap always results in opening the electrical circuit and consequently transmission of a corresponding tampering signal to the receiving monitoring unit. Additionally, or alternatively, monitoring device 10 may include any other known in the art tampering means. For example, in order to detect possible removal of the device as a whole, i.e., by pulling the device over the hand without opening or breaking the device (as might happen for example, if the device is not sufficiently tightened around the wrist) a removal sensor which senses body proximity might be employed. Another example, is a sensor that detects damage to the device.

Housing 20 is a hollow case accommodating a battery 26, a monitoring transmitting module 30 and a clock module 35. Clock module 35 comprises a clock mechanism encased within case 36 and an analog time display plate 12. The clock module 35 is mounted inside watchcase 20 such that time display plate 12 is facing transparent window 19. A crown 29, coupled to the clock mechanism, protrudes from the side wall of housing 20 for allowing resetting the time and date. The monitoring transmitting module 30 includes an electronic circuitry, preferably a printed circuitry board (PCB) which includes a transmitter, for broadcasting data to a receiver (not shown) remote location. The transmitter and corresponding receiver may be of any type suitable for wireless communication. Preferably the transmitter is a radio frequency (RF) transmitter while the receiver at the remote location is a radio frequency receiver. However, the transmitter may be an Infra Red (IR) transmitter transmitting to one or more IR detectors disposed at remote locations. The electronic circuitry is described in more details below, in conjunction with FIGS. 4 and 5. Battery supply 52 supplies power to module 30 and optionally to clock module 35. Alternatively, clock module 35 is powered by a separate battery encased within case 36. Modules 30 and 35 are designed such as to allow a compact packaging within housing 20.

Figure 3:
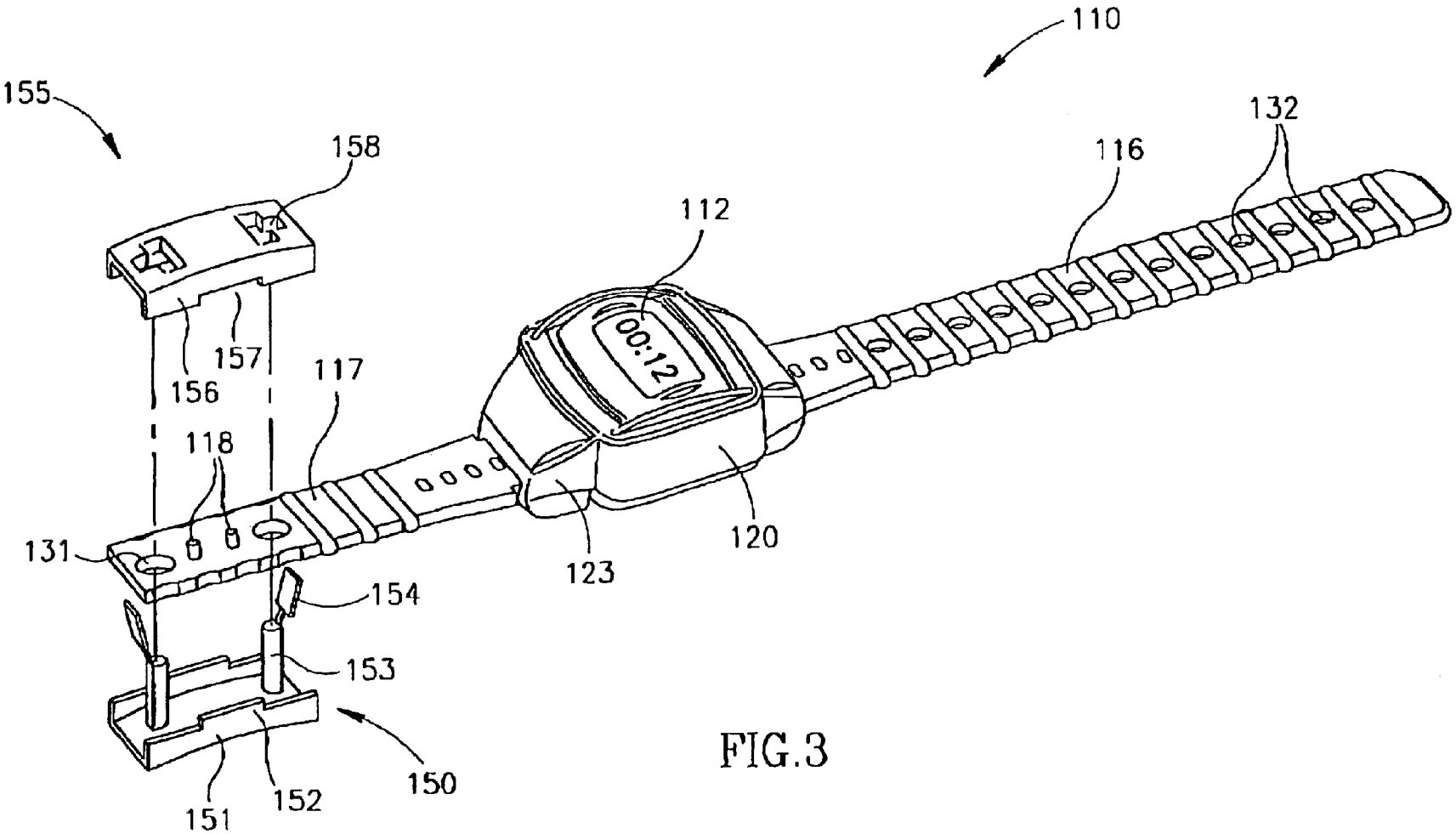
FIGS. 3, 3A, 3B and 3C illustrate a monitoring watch and assembly thereof in accordance with a second embodiment of the present invention.
Figure 3A:
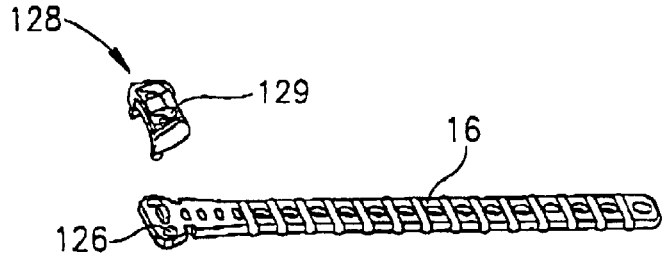
Figure 3B:
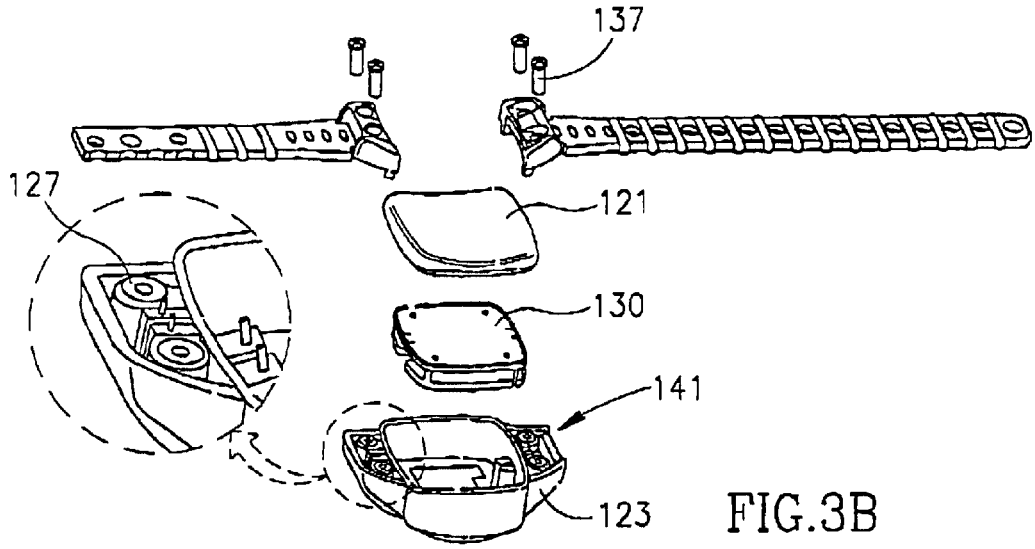
Figure 3C:
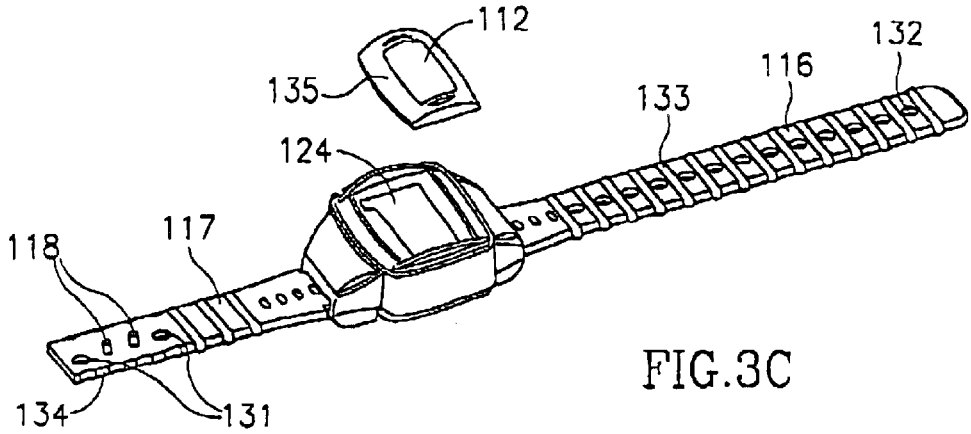

FIG. 3 depict yet another embodiment of the present monitoring device, in according to which the time display is digital. The main components of the device in accordance with this embodiment are similar to those of the analog embodiment described above. The device, generally designated 110, comprises a housing 120 with two side extensions 123 for connecting straps 116 and 117. Plate 121 (best seen in FIG. 3B) closes the open side of housing 120 in a manner which allows for hermetic and waterproof closure. Enclosed within housing 120 is a monitoring transmitting module 130 comprising an electric circuitry 40 and powered by a battery (not shown). A digital clock 135, having a liquid crystal time display 112 is mounted on the front face of housing 120 in an accepting recess 124. Clock 135 is provided with resetting pushbuttons (nor shown) for time resetting. In the embodiment shown here, straps 116 and 117 are of the type disclosed in U.S. Pat. No. 5,504,474, having an electric circuitry extending through the straps and housing, when assembled together, which is electrically opened near the free end of strap 117 and terminates with external connectors 118. Straps 116 and 117 are connected to housing 120 by means of connecting members 128 having each a pair of holes 129 complementary to a pair of holes 126 at one end of each of the straps. Correspondingly, extensions 123 are provided with hollow cylindrical protrusions 127 provided with helical grooves on their inner surface, for accepting screws 131. Extensions 123 are further provided with a pair of connectors 141 which electrically connects housing 120 to the electrical conductors running through straps (not shown). As also disclosed in U.S. Pat. No. 5,504,474 strap 116 is provided with holes 132 along its length and strap 117 is provided with a pair of holes 131 corresponding to the holes 132. Straps 116 and 117 are further provided with complementary ridges 133 and protrusions 134, respectively, for enhancing immobilization of the straps with respect to each other. A closure member comprising of two separate parts, 150 and 155, is provided for closing device 10 around a person wrist both mechanically and electrically. However, as explained above, unlike the closure member disclosed in U.S. Pat. No. 5,504,474, the mechanical locking provided by the closure means of the present invention is preferably reversible such as to allow unfastening the device by caregivers. In the embodiment shown here, the base closure part 150 is provided with two protrusions 153, each terminating with a flexible tongue 154, while the cover closure member 155 is provided with two complementary openings 158. Protrusions 153 and openings 158 are located so as to correspond to each other, and are spaced so as to correspond to pair of holes 131 of strap 117 and to holes 132 of strap 117. The device is fastened around a wrist by inserting protrusions 153 through pair of holes 131 in strap member 117 and through a suitable pair of holes in strap member 116, such that the straps overlap, then tongues 154 are forced through openings 158 of cover closure part 155. In their relaxed position, tongues 154 slide into a narrow portion of opening 158, thus providing mechanical locking which can be opened only by relatively complex operation. In order to enhance immobilization of the two closure parts with respect each other, side walls 151 and 156 of parts 150 and 155 can be shaped to have complementary shaped protrusion 152 and recess 157 for providing snapping locking-in-place means. According to the embodiment shown here, cover closure part 155 further includes means (not shown) for electrically connecting the external connectors 118 such as for example the conductive element described in U.S. Pat. No. 5,504,474. It will be easily realized that the closure means described in conjunction with FIG. 3 is only an example and that many other closure means can be used without departing from the scope of the present invention. For example, base part 150 can be permanently fixed or being an integral part of strap member 117.

Figure 4:
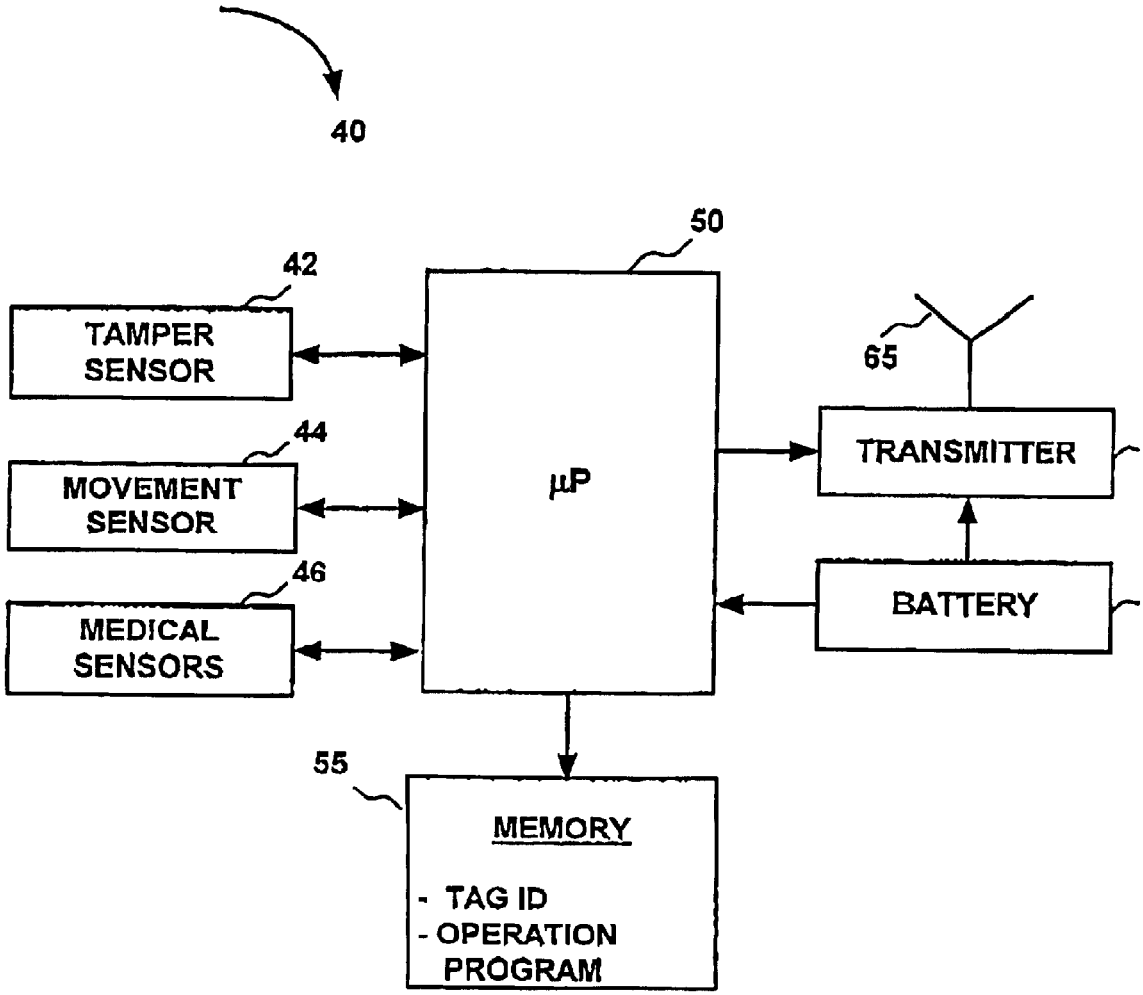
FIG. 4 is a block diagram of an electronic circuitry of a monitoring device in accordance with one embodiment of the present invention.

Turning now to FIG. 4, there is shown a block diagram of the main components of electronic circuitry 40 packaged within monitoring transmitting module 30 (or 130). Electronic circuitry 40 includes an electronic data microprocessor 50 for receiving and processing data, and a transmitter 60 for receiving, processing and transmitting via antenna 65, data regarding the activity of the person to which device 10 is attached. Also included and coupled to microprocessor 50 is a memory device 55 for storing the tag identification code and the operation program for controlling the tag's operation. The data input to microprocessor 50 includes data from at least one tamper sensor 42 for detecting cutting or removal of the device from the patient's wrist. In one embodiment of the present invention at least two tamper sensors 42 provide data input to microprocessor 50. The first tamper sensor may be an open-closure sensor detecting the opening of the electrical circuit running through device 10 when the device is properly secured around the wrist of the monitored person, as explained above, the second tamper sensor may be a body sensor sensing body proximity as for example the short range transmitter-receiver couple disclosed in U.S. Pat. No. 5,504,474. In the embodiment shown here, the electronic circuitry further includes a movement sensor (44) for sensing motion of the person, and might include other sensors (46) as well. Sensors 46 can be incorporated into various physical parts of device 10. In particular, sensors 46 may include sensors for providing information about the medical condition of the monitored person, such as body temperature sensor, pulse sensor, blood pressure sensor, blood-oxygen sensor, etc. Microprocessor 50 is programmed to activate the various sensing means to take readings at predetermined time intervals, to process said readings and to activate transmitter 60 to broadcast signals at predetermined time intervals and at predetermined length and intensity of the signal. The transmitted signals may carry the tag identification code and other data regarding the activities or state of the monitored person in accordance with the sensors input. The microprocessor can be programmed with regard to various parameters in order to meet the requirements specific to the subject to whom the tag is attached. Thus, parameters such as sampling intervals, data transmission intervals, monitored time periods, permitted and barred locations, etc., can be selected according to specific needs. In addition the tag may also be programmed to change the time pattern of sampling and broadcasting when specific circumstances are detected by the sensing means. For example, the tag may, upon occurrence of a predetermined event, issue an alarm signal and increase or decrease the testing rate. Such an event can be an event involving the device operation, for example an attempt to remove the tag, low battery, failure of an electronic component or other component of device 10, or can be an event involving the medical condition or the activities of the monitored person. For example, a temperature above or below predetermined values, lack of motion for a predetermined period of time, etc.

Figure 5:
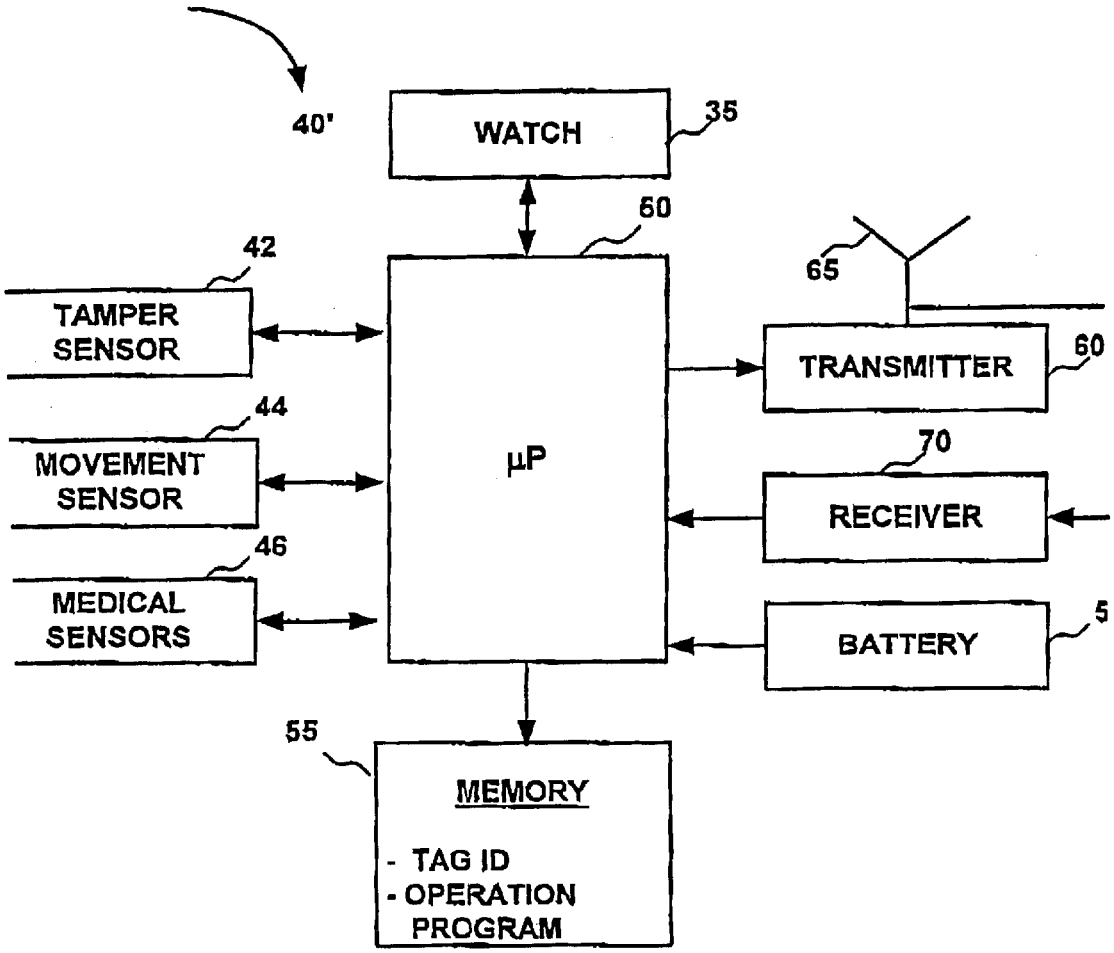
FIG. 5 is a block diagram of an electronic circuitry of a monitoring device in accordance with another embodiment of the present invention.

FIG. 5 depicts another embodiment of an electronic circuitry in which the monitoring unit further includes a receiver 70 for receiving data from remote location or a similar close by device. In accordance with this embodiment, device 10 can be controlled by data received from a remote location. For example, upon reception of a certain data in a local monitoring device, caregivers might decide to change certain parameters in the operation program of the device, such as frequency and intensity of transmitted signals. Further in accordance with this embodiment, clock module 35 is coupled to microprocessor 50 such as to allow time synchronization between microprocessor 50 and watch 35 and to allow remote time resetting of watch 35.

The monitoring device of the present invention can be used with a local monitoring system, with an area monitoring system comprising a plurality of monitoring receiving units, or with a combination thereof. A local monitoring system typically comprises of one local monitoring unit dedicated to a specific transmitting device. The local monitoring unit may report to a central monitoring station or, alternatively, may be an independent station where data is processed for further action. In the context of dementia patients a local monitoring unit is usually employed for supervising a single patient at home. An area monitoring system typically comprises a network of receivers, which cover a restricted or a pre-defined area in which a plurality of tag carriers are moving. In the context of dementia patient such a system may be employed in a nursing home, a hospital, an assisted living center and the like.

It will be appreciated by persons skilled in the art that the present invention is not limited to what has been particularly shown and described hereinabove. Rather the scope of the present invention is defined only by the claims which follow.

What is claimed is:

1. An electronic monitoring device for monitoring, at a remote location, activities of a person suffering from dementia, autism, mental retardation, or a psychiatric related disorder, the device being worn around a wrist of the person being monitored, the device comprising:

a housing having a front face and a back face;

a reversible closure member;

at least one strap connected to the housing and the reversible closure member for fastening the device around the wrist of the person being monitored, wherein the closure member requires at least two hands to be opened;

at least one tamper sensor for detecting tampering with or removal of the device from the person's wrist;

at least one sensor for sensing at least one of a health state and an activity state of the monitored person;

an electronic circuitry enclosed within the housing, the circuitry including a microprocessor and a memory device for receiving and processing data, and a transmitter for periodically transmitting data, the data including data collected by the at least one sensor; and a time display, coupled to a clock mechanism, mounted in the housing so as to be displayed at the front face of the housing.

2. The device of claim 1 wherein said dementia related disorder is Alzheimer disease.

3. The device of claim 1 wherein said time display is an analogue time display.

4. The device of claim 1 wherein said time display is a digital time display.

5. The device of claim 1 further comprising a second tamper sensor for detecting tampering with or the removal of the device from the person's wrist.

6. The device of claim 1 wherein the tamper sensor is an open-closure sensor detecting any attempt of unfastening or breaking the device.

7. The device of claim 1 wherein the tamper sensor is a sensor for detecting removal of the device.

8. The device of claim 1 wherein the tamper sensor is a sensor for detecting damage to the device.

9. The device of claim 6 wherein the tamper sensor detects electrical continuity.

10. The device of claim 1 wherein the tamper sensor detects any interference with the passage of light through an optical fiber, thus detecting tampering with the strap.

11. The device of claim 1 wherein the at least one strap is provided with electric connectors at both its ends and an electric conductive pathway there between, and said at least one strap is electrically connected to said housing such that when the device is secured around the person's wrist, a continuity of electric conductivity is obtained and upon cutting or breaking of the strap or the device the continuity is interrupted, enabling the electronic circuitry to detect such removal.

12. The device of claim 11 wherein the strap is made of a conductive material.

13. The device of claim 1 wherein the closure member is inserted for fixing the effective length of the strap.

14. The device of claim 12 wherein the strap includes optic fibers for identifying tamper event.

15. The device of claim 12 wherein the strap further comprises an infra red device for detecting a tamper event.

16. The device of claim 1 wherein the transmitter is a radio frequency transmitter.

17. The device of claim 1 wherein the transmitter is an Infra Red transmitter.

18. The device of claim 1 wherein the transmitter is wireless.

19. The device of claim 1 wherein the device is provided with an identification code stored in the memory device and wherein the signals periodically transmitted by the transmitter carry said identification code.

20. The device of claim 1 wherein said at least one sensor is selected from the group consisting of a movement sensor, a body temperature sensor, a pulse sensor, a blood pressure sensor, and a blood oxygen sensor.

21. The device of claim 1 wherein the signals carry alternating data associated with the active sensor data output.

22. The device of claim 1 wherein the device further comprises a receiver for receiving data from a remote location.

23. An electronic monitoring device for monitoring, at a remote location, activities of a person suffering from dementia, autism, mental retardation, or a psychiatric related disorder, the device being worn around the wrist of the person being monitored, the device comprising:

a housing having a front face and a back face;

a reversible closure member;

at least one strap connected to the housing and the reversible closure member for fastening the device around the wrist of the person being monitored, wherein the closure member requires at least two hands to be opened;

at least one tamper sensor for detecting tampering with or removal of the device from the person's wrist;

at least one sensor for sensing at least one of an activity state and a health state of the monitored person;

an electronic circuitry enclosed within the housing, the circuitry including a microprocessor and a memory device for receiving and processing data, and a transmitter for periodically transmitting data, the data including a device identification code stored in said memory device and data collected by the at least one sensor; and a time display, coupled to a clock mechanism, mounted in the housing so as to be displayed at the front face of the housing.

* * * * *